United States Patent [19]

Yamamoto et al.

[11] Patent Number: 4,561,987

[45] Date of Patent: Dec. 31, 1985

[54] LUBRICATING AGENTS FOR PROCESSING SYNTHETIC YARNS AND METHOD OF PROCESSING SYNTHETIC YARNS THEREWITH

[75] Inventors: Hisao Yamamoto, Aichi; Fumihiko Kimura, Gamagouri; Osamu Ogiso, Aichi, all of Japan

[73] Assignee: Takemoto Yushi Kabushiki Kaisha, Aichi, Japan

[21] Appl. No.: 639,852

[22] Filed: Aug. 13, 1984

[30] Foreign Application Priority Data

| | | | |
|---|---|---|---|
| Oct. 6, 1983 | [JP] | Japan | 58-187627 |
| Jan. 13, 1984 | [JP] | Japan | 59-5231 |
| Jan. 14, 1984 | [JP] | Japan | 59-5199 |

[51] Int. Cl.[4] ..... D06M 11/00

[52] U.S. Cl. ..... 252/8.9

[58] Field of Search ..... 252/8.9

[56] References Cited

U.S. PATENT DOCUMENTS 4,351,738 9/1982 Takahashi et al. ..... 252/8.9

FOREIGN PATENT DOCUMENTS 52-96297 8/1977 Japan .

*Primary Examiner*—Paul Lieberman
*Assistant Examiner*—Willie J. Thompson
*Attorney, Agent, or Firm*—Flehr, Hohbach, Test, Albritton & Herbert

[57] ABSTRACT

Lubricating agents (spin finish) of this invention for processing synthetic yarns contain 0.05 to 10 wt % of polyalkylene oxide modified polysiloxane of a specified form an 0.5 to 8 wt % of anionic surface active agent in addition to the base of a polyether compound derived from alkylene oxide with 2 to 4 carbon atoms. Such lubricating agents exhibit superior characteristics in the production of textured yarns regarding lubricity, cohesion of yarn, anti-static capabiity and heater-deposit resistance.

8 Claims, No Drawings

LUBRICATING AGENTS FOR PROCESSING SYNTHETIC YARNS AND METHOD OF PROCESSING SYNTHETIC YARNS THEREWITH

BACKGROUND OF THE INVENTION

This invention relates to lubricating agents for processing synthetic yarns (spin finish for synthetic yarns) and a method of processing synthetic textured yarns by using such lubricating agents, and more particularly to lubricating agents which exhibit significantly improved ability to prevent deposit on heaters used in the heating processes (hereinafter abbreviated as heater-deposit resistance) as well as lubricity, cohesion of yarn and anti-static capability.

In the field of production and manufacturing of thermoplastic synthetic fibers, there have recently been improvements in productivity due to semi-automation and shortening of processes. Production of partially oriented yarns (hereinafter abbreviated as POY) and successive or simultaneous draw-false twisting for the production of textured yarn are now being proposed. Faster execution of these processes is also attempted and this trend is presently growing at a fast rate.

With the acceleration in these processes, there arise new requirements for the lubricants to be used in such processes. Since the yarn speed increases and so does the contact pressure on the yarns which run against various machine parts such as rollers, guides, heaters for heat treatments and disks, the lubricating agent must provide high levels of lubricity, cohesion of yarn and anti-static properties to raw yarns for false twisting and in particular to those for drawing-false twisting. Moreover, when there is an increase in the amount of yarns that pass through a heater for heat treatment per unit time or in the torsional strain on the yarns, the centrifugal force will also increase and this will cause all kinds of materials to scatter around. Since the heaters for heat treatments must be made longer and their surface temperature must be raised in order to supply sufficient heat to the filaments for setting crimps, this tends to enhance the thermal degradation of the materials that fall off. Where such thermally degraded components (such as tar) are accumulated on the surface of these heaters, there arise such ill effects as fuzz, breakage of filements and spotty crimps. For this reason, lubricants are now required which are capable of preventing materials from falling off and are superior in heater-deposit resistance.

Lubricating agents containing various compounds have already been proposed for application in the spinning process for smooth execution of the subsequent false twisting process. As explained above, however, it is already impossible with the conventional lubricants to adequately satisfy the conditions for false twisting process which are becoming ever severer. What is actually being done is, for example, to stop the operation of apparatus now and then to clean the surfaces of the heaters. This not only causes a loss in thermal efficiency but also is a movement backwards away from automation because manpower must be expended for the cleaning work, resulting in reduction in production efficiency. Now that the speed of false twisting process is increasing rapidly, it is indispensable that a lubricant used for this process should satisfy the requirements regarding heater-deposit resistance, lubricity, cohesion of yarn and anti-static capability as a whole.

For improving the heat resistance of a feed yarn in heat treatment processes, it used to be considered important to improve the heat resistance of the lubricant itself and studies were made of various lubricants which would not themselves undergo thermal degradation to deposit on the heaters. Examples of such lubricants are shown below, but they are unsatisfactory for one reason or another.

Regarding lubricating agents which are the principal components of lubricating agents, mineral oils and esters of aliphatic acids are inferior from the points of view of fuming characteristics and generation of tar. Esters with quaternary carbon introduced into their molecules (Japanese Patent Tokukai Sho 50-53695) and esters of polyoxyalkylenated bisphenol and aliphatic acid (Japanese Patent Tokko Sho 53-43239) lack the ability to reduce generation of tar. Polydimethylsiloxane and its end modified products generate static electricity significantly and lack scouring ability and compatibility with other components of the lubricants (Japanese Patent Tokko Sho 58-12391, Tokukai Sho 55-67075). As for modified silicones such as methylphenyl polysiloxane and polyepoxysiloxane, they themselves generate insoluble, thermally degraded sludge on the surfaces of the heaters if too much of them (in excess of 10 weight %) is used as components of a lubricant (Japanese Patent Tokukai Sho 49-30621 and Tokukai Sho 51-67415). Even with polyether-type compounds which are considered to be the most useful lubricating agents among known compounds (Japanese Patent Tokukai Sho 56-31077), the problem of heater-deposit occurs as explained above under the severe changes in various conditions related to the increase in the rate of false twisting process. It has also been pointed out that the degree of deposit may increase even more, depending on the type and amount of emulsifier or anti-static agent added to them.

As for constituents other than lubricating agents, addition of a small amount of antioxidant can produce some favorable effects (Japanese Patent Tokko Sho 48-17517 and Tokukai Sho 53-19500) but it is not suitable under conditions of high-speed texturing process. Examples whereby a small amount of polydimethylsiloxane, methylphenyl polysiloxane or polyepoxysiloxane (less than about 10 weight %) is added do not show reduction in generation of tar (Japanese Patent Tokko Sho 54-5040 and Tokukai Sho 55-137273) and they are generally water-insoluble (even if a large amount is used). Moreover, since these compounds should be emulsified in water as components of the lubricant, the added emulsifier itself tends to become a source of heater deposit.

As for components other than lubricating agents such as polyalkylene oxide modified polysiloxane, polyethylene oxide modified polysiloxane does not have sufficient heater-deposit resistance as a lubricant for raw yarns for false twisting (Japanese Patent Tokko Sho 44-27518). As for the use of a polyether compound in combination with linear organic polysiloxane with kinetic viscosity in excess of 15 cst (Japanese Patent Tokukai Sho 48-53093), heater-deposit resistance has been found to be too small in the case, for example, of methyl(polyethylene oxide)polysiloxane. As for the use of a large amount (over 35 weight %) of polyalkylene oxide modified solicone in combination with polyalkylene oxide with affinity (Japanese Patent Tokukai Sho 50-59551), the idea is to reduce the amount of dropping from filaments of modified silicone onto the heaters so that improvement would be made regarding the generation of white sludge on heaters but since, as described above, an increased speed of false twisting or drawing-false twisting results in an increase in the centrifugal force on the yarn, it is extremely difficult to prevent by a physical means to prevent the lubricant constituents from becoming squeezed out and let fly off the fiber surfaces. As for the method of using polyalkylene oxide modified polysiloxane in combination with a reactive silicone compound in the ratio (former/latter) of 5 to 400/100 in weight (Japanese Patent Tokukai Sho 52-96297), the modified polysiloxane itself generates thermally degraded insoluble sludges on the heater surfaces if more than 10 weight % of it is used as component of the lubricant.

SUMMARY OF THE INVENTION

It is therefore an object of the present invention to provide an improved lubricating agent which does not involve the aforementioned disadvantages of the conventional lubricants and can respond to the aforementioned requirements regarding fast manufacturing processes as well as processing method by using such a lubricating agent.

It is another object of the present invention to provide a lubricating agent capable of exhibiting overall high levels of heater-deposit resistance, lubricity, cohesion of yarn and anti-static capability when used for fast manufacturing of simultaneous or successive draw-false twist-fast manufacturing of thermoplastic synthetic yarns such as polyester, polyamide, etc. as well as a processing method of synthetic yarns therewith.

As described above, most of the present methods of improving the heater-deposit resistance in heat treatment processes have as their purposes to improve the tar-generation resistance of the lubricant itself. The present inventors, however, studied the reason why the problem of heater-deposit remained unsolved even with the polyether compounds although the rate of generation of tar from it was reduced as compared to other base components, and having discovered that the sludge which accumulates on the heaters for heat treatment contains, in addition to degradation products, large quantities of oligomers, some polymers and their thermal degradation products generated from the traveling yarn themselves, came to the conclusion that only those lubricating agents capable of concurrently and significantly reducing the generation of tar by thermal degradation of the lubricant itself and the amount of substances falling off the yarn such as oligomers and polymers as well as substances (tar) degraded from them can be used industrially for fast false twisting and draw-false twisting. As a result of further investigation, the present invention was completed by the discovery that lubricating agents containing specified amounts of antistatic agent and lubricating agent to which is added a specified small amount of polyalkylene oxide modified polysiloxane having specified molecular structure and molecular weight and modified in a specified manner can significantly reduce the amount of heater sludge of the aforementioned type.

DETAILED DESCRIPTION OF THE INVENTION

The present invention relates both to a lubricating agent capable of fast processing of synthetic yarns and to a method of processing synthetic yarns by using such a lubricating agent as explained below.

Thus, in one aspect, the present invention relates to lubricating agents of synthetic yarns having as base oil a lubricating agent of which the principal component is a polyether compound derived from alkylene oxide with 2 to 4 carbon atoms and comprising 0.05 to 10 weight % of polyalkylene oxide modified polysiloxane of average molecular weight of over 2500 shown by the following formula (I) and 0.5 to 8 weight % of anionic surface active agent:

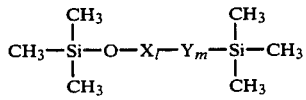

(I)

where X is

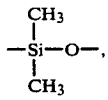

l being an integer in the range of 20 to 100, Y is

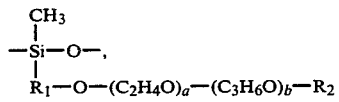

m being an integer in the range of 1 to 9, $R_1$ being alkylene group with 3 to 4 carbon atoms, $R_2$ being hydrogen, alkyl group with 1 to 8 carbon atoms or acyl group with 2 to 8 carbon atoms, a and b being integers which satisfy the inequalities $15 \leqq a+b \leqq 80$ and $2/8 \leqq b/a \leqq 8/2$, and the polydimethylsiloxane part shown by X and the polyalkylene oxide modified siloxane part shown by Y as well as the polyethylene oxide part with subscript a and the polypropylene oxide part with subscript b may be repeated either by block or random repetition.

In another aspect, the present invention relates to a method of processing synthetic yarns that a lubricating agent for processing having a base oil a lubricating agent of which the principal component is a polyether compound derived from alkylene oxide with 2 to 4 carbon atoms and comprising 0.05 to 10 weight % of polyalkylene oxide modified polysiloxane of average molecular weight of over 2500 shown by the aforementioned formula (I) and 0.5 to 8 weight % of anionic surface active agent is deposited on partially oriented yarns of polyester or polyamide wound up at 2000 to 4500 m/min.

In other words, a small amount of polyalkylene oxide modified polysiloxane shown by the aforementioned formula (I) and satisfying the following 5 conditions is added as an indispensable component of the lubricating agent according to the present invention:

(1) Molecular weight is greater than 2500;
(2) Number m of repetitions of Y is 1 to 9;
(3) Ethylene oxide (hereinafter abbreviated as EO) and propylene oxide (hereinafter abbreviated as PO) are repeated (block or random) in the alkylene oxide chain of Y;
(4) Number a of repetition of EO and number b of repetitions of PO must satisfy the relationship $150 \leqq a+b \leqq 80$ and $2/8 \leqq b/a \leqq 8/2$; and (5) Numbers m and l of repetitions of Y and X, respectively, must satisfy the relationship $m/l = 1/100$ to $45/100$.

The objectives of the present invention are not satisfactorily achieved if any of the aforementioned conditions on the formula (I) is not fulfilled. If the molecular weight is less than 2500, for example, the effect is diminished probably because the compound itself cannot withstand the severe conditions of heat treatment in the false twisting process and smokes or evaporates off, failing to form a stable oil membrane. If m is greater than 10 or l is less than 19, its properties come to resemble those of polyether so that the amount of oligomers falling off from the traveling filaments increases and the effects obtainable would be no different from the situation where this compound were not added. If l exceeds 100, not only does heater-deposit resistance become weaker but it itself begins to form varnish-like substance probably because its properties approach those of polydimethyl siloxane. If a and b fail to satisfy the aforementioned conditions, satisfactory results cannot be obtained probably because stable and uniform oil membranes are not formed on the fiber surfaces due either to its own properties or to the lowering of its compatibility with the other components of the lubricating agent.

Compounds which can be described by the general formula (I) can be synthesized easily, for example, by the method of hydrosilylation reaction between the following compounds (i) and (ii):

(i) EO and PO addition compounds of allyl alcohol or compounds obtainable by ethyl etherification, octyl etherification or acetylation of its end (w) hydroxyl group; and (ii) Methyl hydrogen polysiloxane having random or block positioned hydrogen atoms

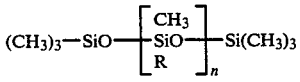

where Rs are a random or block positioned mixture of $CH_3$ and H.

In the present invention, anionic surface active agents are for suppressing generation of static charge on the slipping yarns and to cause the generated static electricity to quickly leak away. One or two kinds of sulfonates, sulfates, phosphates or carboxylates are used but any compound having both a hydrophilic group and a lipophilic group within its molecule which can be used as an antistatic agent can be a candidate. They include salts of alkali metals and organic amines such as alkan sulfonate and alkybenzene sulfonate as examples of sulfonates, salts of alkali metals and organic amines such as higher alcohol sulfates or polyoxyalkylene alkylether sulfate as examples of sulfates, salts of alkali metals and organic amines such as phosphates of various natural and synthetic alcohols and their addition products with alkylene oxide as examples of phosphates, and aliphatic monocarboxylates and dicarboxylates as examples of carboxylates. Of these, salts of sodium, potassium or alkanolamine having alkyl group or alkenyl group with 8 to 18 carbon atoms within their molecule as lipophilic group are preferable.

The polyether compounds which are the principal components of lubricants serving as the base oil according to the present invention, must provide adhesion of yarn bundle during fiber manufacturing processes, show excellent lubricating effects under severe conditions of false twist texturing and itself produce hardly any degraded substances generated by heating. There are no particular restrictions as to their chemical structure but those with molecular weight greater than 700 are preferable. If the average molecular weight is less than 700, fuming characteristics, adhesion of yarn and lubricating ability tend to deteriorate in false twist or draw-false twist texturing process. They can be those obtainable in the presence of a catalyst by ring-opening block or random addition polymerization of cyclic ether monomers such as EO, PO, butylene oxide or tetrahydrofuran to alcohols (monohydric alcohols such as saturated alcohols with 1 to 18 carbon atoms, oleyl alcohol, synthetic alcohols with 10 to 15 carbon atoms, reductive alcohols and hexadecanol, diol with 2 to 12 carbon atoms, polyhydric alcohols such as glycerol and trimethylol propane, alkylphenol, etc.), carboxylic acids (capric acid, adipic acid, trimelitic acid, etc.), amines (laurylamine, ethylene diamine, triethanolamine, etc.), thioethers or mercaptan-like compounds (thioglycol, triethylene glycol dimercaptan, etc.), as well as those obtained by replacing the end hydroxyl group of the above by ether or silyl group or those obtained through condensation of the end hydroxyl group of two of these molecules by replacing by formal or silyl group. As for component of the lubricant, a combined use of such polyethers with an ester compound and/or a mineral oil is also effective. There is no particular limitation as to such ester compounds and/or mineral oils as long as they are practically effective for lubrication and reduction of frictional resistance. From the point of view of the degree of effectiveness and heater-deposit resistance, mono- or di-ester of aliphatic alcohol and monohydric aliphatic acid, mono- or di-ester of polyoxy(ethylene/propylene)aliphatic alcohol and monohydric or dihydric aliphatic acid and refined mineral oil with Redwood viscosity 40 to 200 seconds at 30° C. are preferable.

In short, the lubricating agent according to the present invention is made by adding (A) polyalkylene oxide modified polysiloxane and (B) an anionic surface active agent in specific proportions to a lubricant having as its principal component (C) a polyether compound and the desired synergistic effects can be exhibited by mixing these three components at specific ratios, that is, (A) must be 0.05 to 10 weight %, (B) must be 0.5 to 8 weight % and (C) must be the remaining 82 to 99.45%. If (A) is less than 0.05 weight %, its effects cannot be satisfactorily manifested while the amount of the deposit on the heater and that of the oligomer and polygomer scum generated from the yarn increase. If it exceeds 10 weight %, on the other hand, it generates thermally degraded insoluble sludge, becoming itself a cause of heater contamination. If (B) is less than 0.5 weight %, there will arise all sorts of electrical troubles, while the amount of tar on the heater increases if it exceeds 8 weight %.

The lubricating agent of the present invention may contain appropriate amounts of emulsifier, wetting agent, anti-moulding agent, anti-rust agent, etc., in addition to the chemical compounds mentioned above.

Next, the method of processing fibers with the aforementioned lubricating agents will be explained. The lubricating agents of the present invention show their effectiveness when applied to fibers immediately after spinning. They may be applied to fibers either as an aquous emulsion, a solution with an organic solvent or by themselves (straight oiling). The amount of the effective components of the lubricating agent deposited on synthetic yarns is usually about 0.2 to 1.0 weight % with respect to the yarn.

The lubricating agents of this invention may generally be applied to synthetic fibers inclusive of polypropylene and polyacrylonitrile but their effectiveness is particularly distinctive if they are applied at the rate of 0.25 to 0.7 weight % to POY of polyester or polyamide being wound up at the speed of 2000 to 4500 m/min and it is subsequently subjected to false twist or draw-false twist texturing.

As explained above, the lubricating agents of the present invention contain the aforementioned three components at specific ratios and it is by their synergistic effects that superior over-all stability in connection with fast production and manufacturing hitherto unobtainable by the conventionally available lubricating agents and, in particular, excellent heater-deposit resistance can be obtained. The principal reason for such remarkable effectiveness is that the present invention, unlike the previous efforts which aimed only to reduce the amount of tar generated by the lubricating agents themselves, has succeeded not only in reducing the amount of deposited yarn oligomers and polymers which are constituents of tar on the heater but also in preventing heat degradation of those deposited on the heater.

In what follows, test and comparison examples will be described for more clearly explaining the present invention but they are not intended to limit the scope of the present invention. In the following, the composition of lubricating agent will be described in units of weight % unless specifically noted to be otherwise.

EXAMPLES OF TEST EXPERIMENTS NOS. 1 TO 5 AND COMPARISON EXPERIMENTS NOS. 1 TO 10

Lubricating agents for test experiments Nos. 1 to 5 and comparison experiments Nos. 1 to 10 shown in Table 1 were individually prepared. POY was produced by using each of these lubricating agents and, in all cases, by the following method, and such POY was used for draw-false twist texturing. Evaluation was made regarding the following four points: cross yarn on POY cake, static charge on sliding yarn, fuzz on yarn and deposit on heaters. The results of evaluation are also shown in Table 1, which clearly shows that no cross yarn on POY cake is observed, nor heater deposit or occurrence of electrostatic troubles at the time of draw-false twist texturing of POY if lubricating agents of the present invention are used and that superior false-twisted yarns without fuzz can be obtained. Their superior capabilities are thus fully demonstrated.

(i) Production of POY

Immediately after melt spinning of polyethylene terephthalate, a 10%-emulsion of lubricating agent was applied to the yarn by the kiss-roll method and a 12 kg cake of 115-denier, 36-filament POY was obtained by winding at the rate of 3300 m/min. The amount of lubricating agent deposited on POY was 0.4 to 0.5 weight %.

(ii) Draw-false twist texturing

Twisting system=Three-axis friction spindle (with solid ceramic disk); Speed of yarn=400 m/min; Draw ratio=1.518; Heater on twist side=2 m in length with surface temperature of 210° C.; Heater on untwisting side=none; Intended number of twisting=3200 T/m.

(iii) Evaluation of POY cross yarn (shown in the Tables)

It was examined by observation whether any filament was slipping off in a straight line on the side surface of the POY cake. Its occurrence can cause the filament to break when a POY is unwound in a draw texturing processing.

(iv) Evaluation of static charge on the yarn (shown in the Tables)

Electrostatic voltage of the yarn was measured by a static electrometer (made by Kasuga Denki Kabushiki Kaisha) immediately after passing through the twisting spindle and the delivery rollers and the results were evaluated according to the following standards:

O: Voltage 0 to 300 V

Δ: Voltage 301 to 1000 V

X: Voltage greater than 1000 V (v) Evaluation of fuzz (shown in the Tables)

Appearance of fuzz was examined by observation on the side surface of the cheese (2 kg roll) of false twisted yarn obtained after an operation for 20 days and the results were evaluated according to the following standards:

O: Fuzz not observed

Δ: One or two pieces of fuzz

X: Three or more pieces of fizz (vi) Evaluation of heater deposit (shown in the Tables)

After a continuous operation for 20 days under the aforementioned conditions of draw-false twist texturing, a magnifier was used to examine by observation whether or not tar, scum, sludge, etc. had been generated in the yarn path on the surface of heater. Evaluation was made according to the following standards:

O: Hardly any heater deposit

X: Heater deposit observed

TABLE 1

| | Test Exp't | | | | | Comparison Exp't | | | | | | | | | |
|---|---|---|---|---|---|---|---|---|---|---|---|---|---|---|---|
| | 1 | 2 | 3 | 4 | 5 | 1 | 2 | 3 | 4 | 5 | 6 | 7 | 8 | 9 | 10 |
| (A-1) | 6 | 6 | 6 | .2 | 6 | | | | | | 6 | 6 | 66 | | |
| (B-1) | 4 | 4 | 4 | 4 | 4 | 4 | 4 | 4 | 4 | 4 | | 4 | 4 | 4 | 4 |
| (B-2) | 3 | 3 | 3 | 3 | 3 | 3 | 3 | 3 | 3 | 3 | | 3 | 3 | 3 | 3 |
| (C-1) | 72 | 77 | 87 | 92.8 | 72 | 72 | 72 | 72 | 72 | 72 | 72 | 12 | 12 | 12 | 12 |
| (C-2) | 5 | | | | 15 | 15 | 15 | 15 | 15 | 15 | 15 | 15 | 15 | 15 | 15 |
| (C-3) | 10 | 10 | | | | | | | | | | | | | |
| (A'-1) | | | | | | 6 | | | | | | | | 66 | |
| (A'-2) | | | | | | | 6 | | | | | | | | 66 |
| (A'-3) | | | | | | | | 6 | | | | | | | |
| (A'-4) | | | | | | | | | 6 | | | | | | |
| (A'-5) | | | | | | | | | | 6 | | | | | |
| (B'-1) | | | | | | | | | | | 7 | | | | |
| (C'-1) | | | | | | | | | | | | 60 | | | |
| Cross yarn | No | No | No | No | No | No | No | No | No | No | No | No | No | Ys | No |
| Stat. Voltg | O | O | O | O | O | Δ | Δ | Δ | Δ | Δ | X | O | O | X | X |

TABLE 1-continued

| | Test Exp't | | | | | Comparison Exp't | | | | | | | | | |
|---|---|---|---|---|---|---|---|---|---|---|---|---|---|---|---|
| | 1 | 2 | 3 | 4 | 5 | 1 | 2 | 3 | 4 | 5 | 6 | 7 | 8 | 9 | 10 |
| Fuzz | O | O | O | O | O | Δ | Δ | Δ | Δ | Δ | Δ | X | X | X | X |
| Heater | O | O | O | O | O | X | X | X | X | X | X | X | X | X | X |

In Table 1, (A-1) is one of the following three kinds of polyalkylene oxide modified polysiloxane

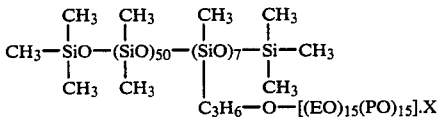

where X is $—CH_3$, $—C_8H_{17}$ or $—COCH_3$, the repetition of the polydimethylsiloxane part and the polyalkylene oxide modified siloxane part and that of EO and PO are both random repetitions; (B-1) is sodium salt of POE(5) lauryl ether sulfate; (B-2) is potassium salt of ricinoleic acid; (C-1) is polyether $C_4H_9—O—[(PO)/(EO)]—CH_3$ with PO/EO=50/50 (weight ratio), by block addition and molecular weight (hereinafter abbreviated as MW)=2000; (C-2) is diethylene glycol dipalmitate; (C-3) is fluid paraffin with Redwood viscosity 90 seconds at 30° C.; (A'-1) is polydimethylsiloxane with viscosity 360 cst at 30° C.; (A'-2) is methylphenyl polysiloxane containing 45 mole % of phenyl and with viscosity 450 cst at 30° C.; (A'-3) is polyepoxy siloxane with 1 weight % epoxified and viscosity 6000 cst at 30° C.; (A'-4) is amino modified silicone containing 10 mole % of amino group with viscosity 1000 cst at 30° C.; (A'-5) is polydimethyl siloxane derivative

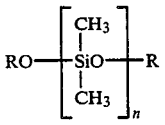

where R consists of 14 mole % of trimethylsilyl and 86 mole % of hydrogen and n=13.8; (B'-1) is lauryl trimethyl ammonium chloride (cationic surface active agent); and (C'-1) is polyether by block addition $C_4H_9—O—[(PO)/(EO)]—CH_3$ with PO/EO=50/50 and MW=550.

EXAMPLES OF TEST EXPERIMENTS NOS. 6 TO 11 AND COMPARISON EXPERIMENTS NOS. 11 TO 14

Lubricating agents for test experiments Nos. 6 to 11 and comparison experiments Nos. 11 to 14 shown in Table 2 were individually prepared. POY was produced by using each of these lubricating agents and, in all cases, by the following method, and such POY was used for draw-false twist texturing. Evaluation was made regarding the following five points: POY cross yarn, static charge on sliding yarn, fuzz on yarn, heater deposit and amount of polyester oligomers in heater deposit (shown in Table 2). The results of evaluation are also shown in Table 2 which clearly shows that no POY cross yarn, heater deposit at the time of POY draw-false twist texturing or occurrence of electrostatic troubles are observed if lubricating agents of the present invention is used and that superior false twisted yarn result fuzz can be obtained.

If comparison experiment No. 14 is considered as a representative example regarding the composition of the heater deposit, it comprises 96 weight % of polyether-type lubricant and 4 weight % of anionic surface active agent and, as is clear from the Table, heater deposit is observed with this example while a large amount of fuzz is seen on the yarn probably because the yarn slides over such contaminant. This heater deposit was collected and quantitatively analyzed by separation of constituents and infrared absorption spectrum as well as by the measurements of melting points (similarly for oligomers for Table 2). It was found as a result that it contained 60 weight % of cyclic oligomers of polyesters, 5 weight % of polymers, 5 weight % of constituent of the lubricating agent and 30 weight % of heat-degraded substances (tar) of the lubricating agent, oligomers and polymers. This means that a large amount of oligomers was contained.

(i) Production of POY

Immediately after melt spinniing of polyethylene terephthalate, a 10% emulsion of lubricating agent was applied to the yarn by the kiss-roll method and a 12 kg cake of 76-denier, 36-filament POY was obtained by winding at the rate of 3500 m/min. The amount of lubricating agent deposited on POY was 0.30 to 0.35 weight %.

(ii) Draw-false twist texturing

Twisting system=Three-axis friction spindle (hard urethane rubber disk); Speed of yarn=800 m/min; Draw ratio=1.518; Heater on twist side=2 m in length with surface temperature of 220° C.; Heater on untwisting side=None; Intended number of twisting=3450 T/m.

(iii) Evaluations of POY cross yarn, static charge on the yarn, fuzz on the yarn and heater contamination were made in the same way as for examples of test experiments Nos. 1 to 5.

TABLE 2

| | Test Exp't | | | | | | Comparison Exp't | | | |
|---|---|---|---|---|---|---|---|---|---|---|
| | 6 | 7 | 8 | 9 | 10 | 11 | 11 | 12 | 13 | 14 |
| (A-2) | 10 | 10 | 7 | 5 | 3 | .5 | 3 | 3 | | |
| (B-3) | 2 | 2 | 2 | 2 | 2 | 2 | .1 | 5 | 2 | 2 |
| (B-4) | 2 | 2 | 2 | 2 | 2 | 2 | .1 | 5 | 2 | 2 |
| (C-4) | 40 | 60 | 63 | 65 | 67 | 69.5 | 70.8 | 70 | 80 | |
| | | | | | | | 61 | | | |
| (C-5) | 16 | 16 | 16 | 16 | 16 | 16 | 16 | 16 | 16 | 16 |
| (C-6) | 30 | | | | | | | | | |
| (C-7) | | 10 | 10 | 10 | 10 | 10 | 10 | 10 | 10 | |
| POY Cross Yarn | No | No | No | No | No | No | No | No | No | No |
| Static Charge | O | O | O | O | O | O | X | O | O | O |
| Fuzz | O | O | O | O | O | X | O | O | O | O |
| Heater Contmnt | O | O | O | O | O | O | O | X | X | X |
| Oligomers | — | — | — | — | — | — | — | * | 55 | 60 |

In Table 2, "-" indicates that measurement was not possible because there were hardly any contaminants;

"*" is 10 if Y in (A-2) is —H or —$C_4H_9$ and 12 if Y in (A-2) is —$COC_3H_7$; (A-2) is polyalkylene oxide modified polysiloxane

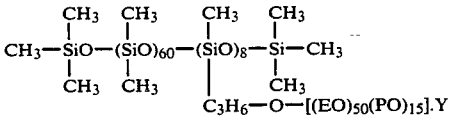

where Y is —H, —$C_4H_9$ or —$COC_3H_7$, the repetition of the polydimethyl siloxane part and the polyalkylene oxide modified siloxane part is random repetition and the repetition of EO and PO is block repetition; (B-3) is potassium salt of POP(4) octyl phosphate; (B-4) is triethanolamine salt of isostearic acid; (C-4) is polyether

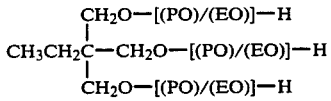

with PO/EO=85/15, by random addition and MW=3500; (C-5) is polyether $C_{12}H_{25}O[(PO)/(EO)]$—H with PO/EO=40/60, by block accition and MW=1800; (C-6) is POE(7) octylether octanoate; and (C-7) is isooctyl laurate.

EXAMPLES OF TEST EXPERIMENTS NOS. 12 TO 15 AND COMPARISON EXPERIMENTS NOS. 15 TO 27

Each of the lubricating agents described in Table 3 was used for these testing by the following method in all cases as in test experiments Nos. 1 to 5. The results are shown in Table 3, which clearly indicates the superior characteristics of the lubricating agents according to the present invention.

(i) Production of POY

Immediately after melt spinning of polyamide (6,6 nylon), a 13% emulsion of lubricating agent was applied to the yarn by the guide oiling method and a 8 kg cake of 36-denier, 7-filament POY was obtained by winding at the rate of 4000 m/min. The amount of lubricating agent deposited on POY was 0.45 to 0.55 weight %.

(ii) Draw-false twist texturing

Twisting system=Three-axis friction spindle (hard urethane rubber disk); Speed of yarn=1100 m/min; Draw ratio=1.200; Heater on twist side=2.5 m in length with surface temperature of 230° C.; Heater on untwisting side=None; Intended number of twisting=3000 T/m.

(iii) Evaluations of POY cross yarn, static charge on the yarn, fuzz on yarn and heater contamination were made in the same way as in the case of test experiments Nos. 1 to 5 except the latter two evaluations were made after 10 days of continuous operation.

TABLE 3

| | Test Exp't | | | | Comparison Exp't | | | | | | | | | | | | |
|---|---|---|---|---|---|---|---|---|---|---|---|---|---|---|---|---|---|
| | 12 | 13 | 14 | 15 | 15 | 16 | 17 | 18 | 19 | 20 | 21 | 22 | 23 | 24 | 25 | 26 | 27 |
| (A-3) | 1 | | | | | | | | | | | | | | | .03 | 13 |
| (A-4) | | 1 | | | | | | | | | | | | | | | |
| (A-5) | | | 1 | | | | | | | | | | | | | | |
| (A-6) | | | | 1 | | | | | | | | | | | | | |
| (B-5) | 2 | 2 | 2 | 2 | 2 | 2 | 2 | 2 | 2 | 2 | 2 | 2 | 2 | 2 | 2 | 2 | 2 |
| (C-8) | 97 | 97 | 97 | 97 | 97 | 97 | 97 | 97 | 97 | 97 | 97 | 97 | 97 | 97 | 97 | * | 85 |
| (A'-6) | | | | | 1 | | | | | | | | | | | | |
| (A'-7) | | | | | | 1 | | | | | | | | | | | |
| (A'-8) | | | | | | | 1 | | | | | | | | | | |
| (A'-9) | | | | | | | | 1 | | | | | | | | | |
| (A'-10) | | | | | | | | | 1 | | | | | | | | |
| (A'-11) | | | | | | | | | | 1 | | | | | | | |
| (A'-12) | | | | | | | | | | | 1 | | | | | | |
| (A'-13) | | | | | | | | | | | | 1 | | | | | |
| (A'-14) | | | | | | | | | | | | | 1 | | | | |
| (A'-15) | | | | | | | | | | | | | | 1 | | | |
| (A'-16) | | | | | | | | | | | | | | | 1 | | |
| Cross Yn | No | No | No | No | No | No | No | No | No | No | No | No | No | No | No | No | No |
| Stat. Chg | O | O | O | O | O | O | O | O | O | O | O | O | O | O | O | O | O |
| Fuzz | O | O | O | O | X | X | X | X | X | X | X | X | X | X | X | Δ | Δ |

In Table 3, * was 97.97; (A-3) to (A-6) and (A'-1) to (A'-16) are polyalkylene oxide modified polysiloxane of the aforementioned general formula (I) where l, m, a, b, $R_1$ and $R_2$ are as given in Table 4; (B-5) is sodium salt of mixed alkan sec sulfonate with 12 to 15 carbon atoms; and (C-8) is polyether $C_4H_9$—O—[(PO)/(EO)]—H with PO/EO=80/20, by random addition and MW=3000.

TABLE 4

| | l | m | a | b | $R_1$ | $R_2$ #1 | $R_2$ #2 | $R_2$ #3 | Repetition of l and m | Repetition of a and b |
|---|---|---|---|---|---|---|---|---|---|---|
| (A-3) | 20 | 4 | 5 | 15 | $C_3H_6$ | H | $C_6H_{13}$ | $CH_3CO$ | Random | Random |
| (A-4) | 30 | 3 | 30 | 15 | $C_3H_6$ | $CH_3$ | $C_4H_9$ | $CH_3CO$ | Random | Random |
| (A-5) | 50 | 5 | 15 | 15 | $C_4H_8$ | H | $C_6H_{13}$ | $C_7H_{15}CO$ | Block | Block |
| (A-6) | 90 | 2 | 10 | 25 | $C_3H_6$ | H | $C_4H_9$ | $CH_3CO$ | Random | Random |
| (A'-6) | 20 | 30 | 5 | 15 | $C_3H_6$ | H | $C_6H_{13}$ | $CH_3CO$ | Random | Random |
| (A'-7) | 30 | 3 | 80 | 40 | $C_3H_6$ | $CH_3$ | $C_4H_9$ | $CH_3CO$ | Random | Random |
| (A'-8) | 4 | 5 | 15 | 15 | $C_4H_8$ | H | $C_6H_{13}$ | $C_7H_{15}CO$ | Block | Block |
| (A'-9) | 120 | 2 | 10 | 25 | $C_3H_6$ | H | $C_4H_9$ | $CH_3CO$ | Random | Random |

TABLE 4-continued

| | l | m | a | b | $R_1$ | $R_2$ #1 | #2 | #3 | Repetition of l and m | Repetition of a and b |
|---|---|---|---|---|---|---|---|---|---|---|
| (A'-10) | 20 | 30 | 2 | 3 | $C_3H_6$ | $CH_3$ | $CH_3$ | $CH_3$ | Random | Random |
| (A'-11) | 0 | 9 | 20 | 20 | $C_3H_6$ | H | H | H | — | Random |
| (A'-12) | 20 | 2 | 20 | 0 | $C_3H_6$ | H | H | H | Random | — |
| (A'-13) | 20 | 2 | 20 | 4 | $C_3H_6$ | H | H | H | Random | Random |
| (A'-14) | 20 | 2 | 3 | 20 | $C_3H_6$ | H | H | H | Random | Random |
| (A'-15) | 30 | 3 | 80 | 40 | $C_3H_6$ | $CH_3$ | $CH_3$ | $CH_3$ | Random | Random |
| (A'-16) | 20 | 30 | 5 | 15 | $C_3H_6$ | H | H | H | Random | Random |

We claim:

1. A lubricating agent for processing synthetic yarns, said lubricating agent comprising a lubricant as base oil thereof, said lubricant having as principal constituent thereof 82% to 99.45 weight percent of a polyether compound derived from alkylene oxide with 2 to 4 carbon atoms, 0.05 to 10 weight % of polyalkylene oxide modified polysiloxane which is shown by the general formula (I) and has average molecular weight greater than 2500 and 0.5 to 8 weight % of anionic surface active agent, the weight percent being based on the total weight of the three components.

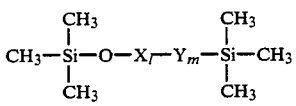

(I)

where X is

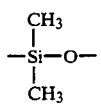

l is an integer from 20 to 100, Y is

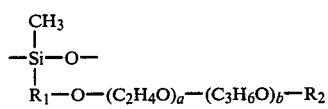

m is an integer from 1 to 9, $R_1$ is alkylene group with 3 to 4 carbon atoms, $R_2$ is hydrogen, alkyl group with 1 to 8 carbon atoms or acyl group with 2 to 8 carbon atoms, a and b are integers satisfying $15 \leqq a+b \leqq 80$ and $2/8 \leqq b/a \leqq 8/2$, and the repetition of X and Y and the repetition of $(C_2H_4O)$ and $(C_3H_6O)$ in Y may be either block or random repetition.

2. The lubricating agent of claim 1 wherein said lubricant contains an ester compound.

3. The lubricating agent of claim 1 wherein said lubricant contains a mineral oil.

4. The lubricating agent of claim 2 wherein said lubricant further contains a mineral oil.

5. A method of processing synthetic yarns comprising the step of applying a lubricating agent to a partially oriented yarn of polyester or polyamide fiber which is being wound at the speed of 2000 to 4500 m/min, said lubricating agent comprising a lubricant as base oil thereof, said lubricant having as principal constituent thereof a polyether compound derived from alkylene oxide with 2 to 4 carbon atoms, 0.05 to 10 weight % of polyalkylene oxide modified polysiloxane which is shown by the general formula (I) and has average molecular weight greater than 2500 and 0.5 to 8 weight % of anionic surface active agent;

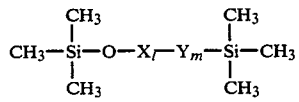

(I)

where X is

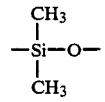

l is an integer from 20 to 100, Y is

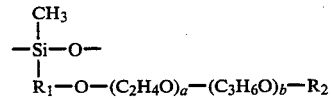

m is an integer from 1 to 9, $R_1$ is alkylene group with 3 to 4 carbon atoms, $R_2$ is hydrogen, alkyl group with 1 to 8 carbon atoms or acyl group with 2 to 8 carbon atoms, a and b are integers satisfying $15 \leqq a+b \leqq 80$ and $2/8 \leqq b/a \leqq 8/2$, and the repetition of X and Y and the repetition of $(C_2H_4O)$ and $(C_3H_6O)$ in Y may be either block or random repetition.

6. The method of claim 5 wherein said lubricant contains an ester compound.

7. The method of claim 5 wherein said lubricant contains a mineral oil.

8. The method of claim 6 wherein said lubricant further contains a mineral oil.

* * * * *